US006397574B1

(12) United States Patent
De Angelis

(10) Patent No.: US 6,397,574 B1
(45) Date of Patent: Jun. 4, 2002

(54) SHEATHLESS SYNTHETIC FIBER ROPE

(75) Inventor: Claudio De Angelis, Lucerne (CH)

(73) Assignee: Inventio Ag, Hergiswil NW (CH)

( * ) Notice: Subject to any disclaimer, the term of this patent is extended or adjusted under 35 U.S.C. 154(b) by 0 days.

(21) Appl. No.: 09/449,330

(22) Filed: Nov. 24, 1999

(30) Foreign Application Priority Data

Nov. 25, 1998 (EP) ..... 98811165

(51) Int. Cl.[7] ..... D02G 3/36

(52) U.S. Cl. ..... 57/251; 57/231; 57/232; 57/250; 57/258; 187/266; 187/406; 187/411; 428/357

(58) Field of Search ..... 187/266, 406, 187/411; 57/251, 231, 232, 250, 258; 428/357

(56) References Cited

U.S. PATENT DOCUMENTS 5,460,881 A * 10/1995 Hsu ..... 428/357

5,566,786 A * 10/1996 De Angelis et al. ..... 187/266

OTHER PUBLICATIONS

D. Hull and T.W. Clyne, "An Introduction to Composite Materials" (1996), Cambridge University Press, 2nd Edition.*

* cited by examiner

*Primary Examiner*—John J. Calvert
*Assistant Examiner*—Shaun R Hurley
(74) *Attorney, Agent, or Firm*—MacMillan, Sobanski & Todd, LLC

(57) ABSTRACT

A synthetic rope has multiple layers of load-bearing aramide fiber strands laid together with a coating on the synthetic fiber strands in the outermost layer of strands. The coating includes an impregnating substance with additives of UV stabilizers, short fibers, and oxidation and reduction blockers to provide reliable protection against environmental influences damaging to the rope, as well as an unchanged adequate resistance of the synthetic fiber rope to abrasion.

19 Claims, 1 Drawing Sheet

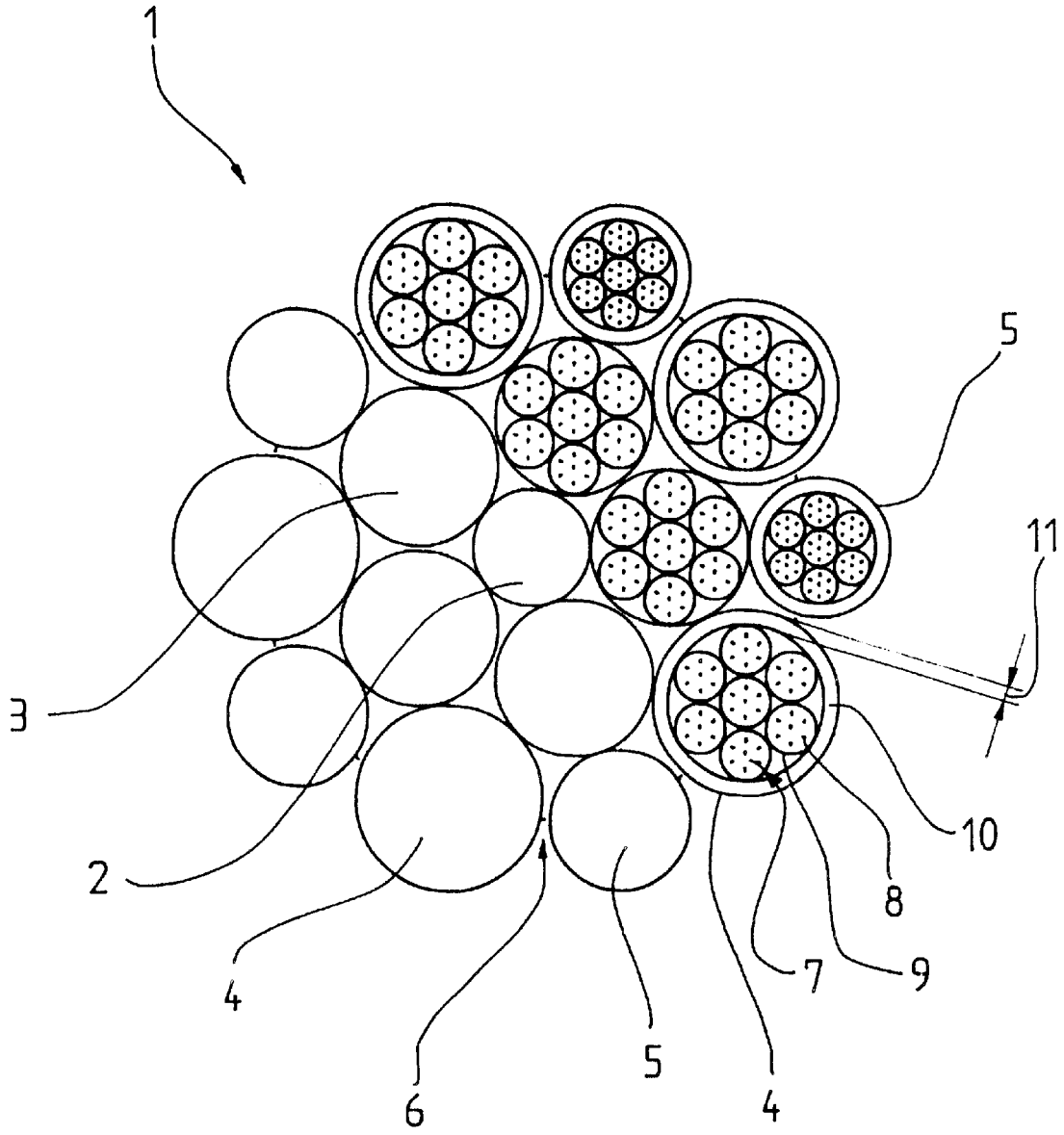
1
5
11
3
2
10
8
4
7
9
6
5
4

SHEATHLESS SYNTHETIC FIBER ROPE

BACKGROUND OF THE INVENTION

The present invention relates to a synthetic fiber rope, preferably of aromatic polyamide, with load-bearing strands of bonded synthetic fibers, preferably being laid in an outermost layer of strands on a rope core made up of load-bearing synthetic fiber strands laid together in layers, and a coating surrounding at least the load-bearing synthetic fiber strands of the outermost layer of strands.

In conveying technology, for example such as on elevators, in crane construction, and in open-pit mining, moving ropes are an important element of machinery and subject to heavy use. An especially complex aspect is the loading of driven ropes, over pulley deflected ropes or ropes wound on drums, for example as they are used in elevator construction and for suspended cable cars. In these instances the lengths of rope needed are large, and considerations of energy lead to the demand for smallest possible masses. High-tensile synthetic fiber ropes, for example of aromatic polyamides or aramides with highly oriented molecule, chains, fulfil these requirements better than conventional steel ropes. However, materials such as aramides are particularly sensitive to ultraviolet (UV) light, and environments having an oxidizing or reducing effect, which cause the breaking stress and work capacity to be diminished. For this reason, aramide ropes usually are covered with a sheath or braid of material that is stable to light.

For example, from the European patent document 0 672 781 A1, it is known to use such sheathed synthetic fiber ropes for the suspension elements of elevator installations, so as to connect the car frame of a car which is guided in an elevator hoistway to a counterweight. To raise and lower the car and the counterweight, the rope runs over a traction sheave that is driven by a drive motor. The drive torque is transferred by friction to the section of rope that at any moment is lying in the angle of wrap.

In this example, instead of there being a sheath surrounding the entire covering layer of strands, each individual strand of this layer is given a seamless extruded sheath of synthetic material, preferably polyurethane or polyamide, all of these together serving as a protection against abrasion of the rope, and ensuring the desired coefficient of friction on the traction sheave.

In this case, the adhesive forces between the sheaths of synthetic material and the outermost layer of synthetic fiber strands are achieved by the sheath of synthetic material being extruded on under pressure, so that all interstices between the strands are filled, and a form-fit with a large area of adhesion is created. Under certain conditions, however, the transverse forces that arise when the rope is loaded can cause displacement or piling-up of the synthetic sheath. Such changes in the rope are undesirable, as they could lead to failure of the rope. However, using the extrusion process to apply to the strands the sheath needed to create the necessary adhesive forces between the strands and the sheath is expensive.

SUMMARY OF THE INVENTION

An objective of the present invention is to reduce the cost of producing a synthetic fiber rope, while ensuring an unchanged high level of functionality.

Extensive tests by the applicant have shown that instead of an extruded protective sheath as hitherto used, lasting assurance of reliable protection against UV, as well as adequate resistance of the rope to abrasion, can be achieved by only coating the synthetic fiber strands in the outermost layer of strands with liquid containing UV stabilizers arid other additives as protection against abrasion and environmental influences damaging to the rope.

The advantages resulting from the present invention consist of a lasting bond of the coating to the synthetic fiber strands of the outermost layer of strands, because the material of the coating and of the matrix binding the synthetic fibers of the strands is the same. By simply admixing appropriate additives the functionality can be easily extended to the entire lifetime of fiber ropes. The coating according to the present invention does not form pile-ups, nor can it be displaced on the synthetic fiber strands. Manufacture of the coating takes place to a large extent without additional expense for tools and equipment, and is simple and inexpensive. Taking large-series manufactured conventional synthetic fiber strands as the starting point, the synthetic fiber strands for the outermost layer of fiber strands have only to be drawn through an impregnating bath, which is present in any case, to form the coating according to the invention. The thickness of the coating can be adjusted via the time spent by the synthetic fiber strands in the impregnating bath. Furthermore, the coating process can be repeated an unlimited number of times.

A particularly abrasion-resistant embodiment of the coating is achieved by adding short fibers, consisting for example of aramide, to the impregnating bath.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which:

The FIGURE is a cross-sectional view of a stranded synthetic fiber rope in accordance with the present invention.

DESCRIPTION OF THE PREFERRED EMBODIMENT

A preferred exemplary embodiment of the present invention with impregnating substance in liquid form is described below by reference to the drawing showing a cross-sectional view of a rope 1 composed of sixteen strands. A core strand 2 has helically laid around it five identical strands 3 on which five thicker strands 4, alternating with five thinner strands 5, are laid in parallel lay to form a covering layer 6. The load-bearing strands 2, 3, 4 and 5 used for the rope 1 shown are twisted or laid from individual bundles of a plurality of aramide filaments 7.

The rope 1 can be used as a means of suspension and hoisting in elevator installations, for example by being driven via a rope sheave or rope drum. In such installations the car sling of the car, which is moved in an elevator hoistway, and a counterweight are connected together by a rope. To raise and lower the car and the counterweight, the rope runs over a traction sheave which is driven by a drive motor. The drive torque is transferred by friction to the section of the rope which at any moment is lying in the angle of wrap. At this point the rope is subjected to high transverse forces. A typical elevator installation having a car and a counterweight supported by a rope is shown in the U.S. Pat. No. 5,566,786 which is incorporated herein by reference.

The strands 2, 3, 4 and 5 consist essentially of aramide threads 8, which are helically bonded in a matrix of polyurethane. For laying or twisting, the aramide threads 8 are treated with a protective impregnating substance, for example with a polyurethane solution. The proportion of polyurethane in each strand 2, 4 and 5 is a co-determinant of the fatigue strength under reverse bending stress of the rope 1. The higher the proportion of polyurethane, the higher the reverse bending performance. As the proportion of polyurethane increases, the fill factor of the entire rope 1 decreases, and with it the load-bearing capacity and elongation behavior of the rope 1. Depending on the rope properties desired, the proportion of polyurethane for impregnation of the strands 2, 4 and 5 can be, for example, between ten and sixty percent.

By way of example, in the embodiment illustrated, seven aramide threads 8 are joined together and bonded into the filament 7 by means of impregnation. In this way, the impregnation forms a thin protective layer 9 around each individual filament 7. Seven of the filaments 7 are laid together helically into the strands 2, 3, 4 and 5. In the actual embodiment, the filaments 7 do not have the circular shape shown in the drawing, but are adapted to the surface of adjacent filaments and the strands. To this extent, the structure of all the strands 2, 3, 4 and 5 used in the exemplary embodiment is, as a general rule, identical, but the number of twists per meter can vary between the various layers of strands, and between the strands having various diameters.

According to the present invention, each of the thick strands 4 and thin strands 5 laid in the covering layer 6 is surrounded by an additional protective layer 10 of impregnating substance. It is advantageous for this protective layer to be formed on the surface of the thick strands 4 and thin strands 5 by their being given an additional soaking in a bath of impregnating substance in a draw-through process. In addition to polyurethane, the impregnating substance also contains as additives UV stabilizers, preferably silicon crystals, and oxidation and reduction blockers. Adding short fibers, preferably of aramide, gives the protective layer 10 improved abrasion resistance.

Here, the thickness 11 of the protective layer 10 around the individual strands 4 and 5 is 0.2 mm; however, according to the invention, it can be selected in the range between 0.1 and 1 mm depending on the protective effect desired. The protective layer 10 functions as a protection against abrasion between the thick strands 4 and the thin strands 5 of the covering layer 6, and bonded together with all the strands 4 and 5 of the covering layer 6 forms a coating for the rope 1 which is as effective as it is inexpensive to manufacture. Because of this, an additional rope sheath of synthetic material can be dispensed with. According to the invention, strands 4 and 5 coated with a protective coating 10 can be manufactured in advance as a semi-finished product, and then processed further as required using conventional rope-making machinery, which significantly reduces the manufacturing costs of the aramide fiber rope 1.

Instead of an impregnating substance, a different liquid with adhesive properties can also be applied to the rope.

As well as being used purely as a suspension rope, the rope can be used in a wide range of equipment for handling materials, examples being elevators, hoisting gears in mines, building cranes, indoor cranes, ship's cranes, aerial cableways, and ski lifts, as well as a means of traction on escalators. The drive can be applied by friction on traction sheaves or Koepe sheaves, or by the rope being wound on round drums. A hauling rope is to be understood as a moving, driven rope, which is sometimes also referred to as a traction or suspension rope.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. In a rope having load-bearing strands of bonded synthetic fibers, an outermost layer of the strands being laid on a rope core made up of load-bearing synthetic fiber strands laid together in layers, the improvement comprising: a coating surrounding at least the load-bearing synthetic fiber strands of the outermost layer of strands forming a protective layer about each of the strands individually, said coating being applied as a liquid to the strands prior to laying the strands in the outermost layer of strands of the rope and including in said coating admixtures of UV stabilizers and additives for protection against abrasion and environmental influences damaging to the rope, said outermost layer of strands forming a sheathless outer surface of the rope.

2. The synthetic rope according to claim 1 wherein said coating includes an impregnating substance for bonding said synthetic fibers together.

3. The synthetic rope according to claim 2 wherein said impregnating substance contains short fibers for protection against abrasion.

4. The synthetic rope according to claim 3 wherein said short fibers are aramide fibers.

5. The synthetic rope according to claim 2 wherein said additives are oxidation and reduction blockers.

6. The synthetic rope according to claim 2 wherein said impregnating substance includes a polyurethane solution.

7. The synthetic rope according to claim 1 wherein said coating has a layer thickness of between 0.1 mm and 1 mm.

8. The synthetic rope according to claim 1 wherein the strands are formed of a plurality of bundles of aramide threads, each said bundle having a thin protective layer of a polyurethane material.

9. A method for manufacturing a synthetic rope of bundles of synthetic fibers, the bundles being bonded into a plurality of load-bearing synthetic fiber strands, the load-bearing strands being laid together as a core of the strands surrounded by an outer layer of the strands, comprising the steps of: a. providing a quantity of liquid coating including an impregnating substance and additives protecting against abrasion and environmental influences that are damaging to the rope; b. soaking the strands to be used in the outer layer in the liquid coating to form a predetermined thickness coating on the strands of the outer layer of the strands; c. removing the coated strands from the liquid coating; and d. forming a sheathless rope having a core of strands surrounded by the coated strands in an outer layer.

10. The method according to claim 9 including forming the bundles from polyamide fibers.

11. The method according to claim 9 wherein after step b. is performed, short strands are applied to the coated strands and the coated strands are further coated by soaking in the liquid coating.

12. An elevator installation comprising:

an elevator car;

a traction means; and a synthetic fiber rope in friction contact with said traction means and supporting said elevator car, said rope having at least a core and an outer layer of load-bearing synthetic fiber strands, said strands of said outer layer being covered individually by a coating including admixtures of UV stabilizers and additives for protection against abrasion and environmental influences damaging to the rope to form a sheathless outer layer of said rope.

13. The elevator installation according to claim 12 wherein said coating includes an impregnating substance for bonding said synthetic fibers together.

14. The elevator installation according to claim 12 wherein said impregnating substance contains short fibers for protection against abrasion.

15. The elevator installation according to claim 14 wherein said short fibers are aramide fibers.

16. The elevator installation according to claim 12 wherein said additives are oxidation and reduction blockers.

17. The elevator installation according to claim 12 wherein said impregnating substance includes a polyurethane solution.

18. The elevator installation according to claim 12 wherein said coating has a layer thickness of between 0.1 mm and 1 mm.

19. The elevator installation according to claim 12 wherein the strands are formed of a plurality of bundles of aramide threads, each said bundle having a thin protective layer of a polyurethane material.

* * * * *